US008539628B2

(12) United States Patent
Lee

(10) Patent No.: US 8,539,628 B2
(45) Date of Patent: Sep. 24, 2013

(54) INFANT MATTRESS THAT FITS SAFELY IN A CRIB

(75) Inventor: Youn Jae Lee, Pleasanton, CA (US)

(73) Assignee: Zinus, Inc., San Leandro, CA (US)

( * ) Notice: Subject to any disclaimer, the term of this patent is extended or adjusted under 35 U.S.C. 154(b) by 94 days.

(21) Appl. No.: 12/584,888

(22) Filed: Sep. 14, 2009

(65) Prior Publication Data

US 2011/0061163 A1 Mar. 17, 2011

(51) Int. Cl.
*A47D 7/00* (2006.01)

(52) U.S. Cl.
USPC ..... 5/739; 5/93.1

(58) Field of Classification Search
USPC ..... 5/946, 739, 425, 732, 327, 93.1
See application file for complete search history.

(56) References Cited

U.S. PATENT DOCUMENTS 3,803,646 A * 4/1974 Newerowski ..... 5/93.1
5,960,496 A * 10/1999 Boyd ..... 5/931
6,199,234 B1 3/2001 Srour et al. ..... 5/736
6,370,718 B1 * 4/2002 Schmid ..... 5/93.1
2007/0204407 A1 * 9/2007 Lee ..... 5/720
2009/0106894 A1 * 4/2009 Yeo ..... 5/93.1
2010/0115703 A1 * 5/2010 Kluft ..... 5/716
2010/0170042 A1 * 7/2010 Rose ..... 5/739
2010/0223734 A1 * 9/2010 Oh ..... 5/740

* cited by examiner

*Primary Examiner* — Peter M Cuomo
*Assistant Examiner* — Brittany Wilson
(74) *Attorney, Agent, or Firm* — Imperium Patent Works; Darien K. Wallace

(57) ABSTRACT

An infant mattress fits safely in a crib without any gap between the mattress and the walls or bars of the crib. A ring of memory foam surrounds the supporting foam layers of the mattress and forms a snug fit with the vertical bars of the crib regardless of whether the dimensions of the particular crib or mattress vary from their standard sizes. The memory foam ring intentionally renders the infant mattress somewhat larger than the inner dimensions of the crib. The ring compresses when the mattress is placed in a crib in which opposing side bars are separated by a distance that is smaller than the mattress width. The ring is formed by pouring foam into a rectangular mold around the supporting foam layers. Where the mattress includes pocket coils on the supporting foam layers, the ring of memory foam conforms to the outer row of pocket coils.

18 Claims, 6 Drawing Sheets

INFANT MATTRESS THAT FITS SAFELY IN A CRIB

TECHNICAL FIELD

The present invention relates to mattresses, and in particular to infant mattresses that provide safe sleeping surfaces in cribs.

BACKGROUND INFORMATION

Mattresses used in cribs for infants have conventionally resembled adult mattresses built to a smaller scale. For various reasons, however, the requirements of a crib mattress are different than what is required for adult sized mattresses, such as single, twin, queen and king sizes. For example, the weight of an infant is so much less than the weight of an adult that a regular mattress simply built to a smaller scale is too stiff and unyielding for a recumbent infant. Mattress designs that provide additional edge support to compensate for the effects of people sitting on the edge of their beds actually detract from the quality of a crib mattress. Fitting within the side bars or walls of a crib is another requirement that is not critical for an adult sized mattress that simply sits on top of a box spring.

A stiff crib mattress cannot be forced to fit inside the crib if the mattress is too large. Even a conventional foam mattress, as opposed to an innerspring mattress, that is too large will bulge if the mattress is forced into a crib with smaller dimensions. Thus, crib mattresses are typically manufactured to be smaller than the standard crib size in order to provide some tolerance to compensate for variations in manufacturing processes of the crib and the mattress. For example, sizes vary even among individual cribs of the same model manufactured by the same company. Sizes of individual mattresses also vary even among the same model of crib mattress manufactured by the same company. Thus, to ensure that a crib mattress fits any particular crib, the typical conventional crib mattress can be a couple of inches too short and too narrow.

FIG. 1 (prior art) shows a conventional crib assembly 10 including a crib 11 and an infant mattress 12. The outer dimensions of infant mattress 12 are smaller than the inner dimensions of the bars 13 that form a frame around the mattress. Consequently, there is a gap 14 between the edges 15 of mattress 12 and bars 13. Gap 14 is dangerous because an infant could become trapped in gap 14 between mattress 12 and bars 13. The baby's hands, legs or even head could become wedged between crib 11 and ill fitting mattress 12.

FIG. 2 (prior art) shows a conventional way of trying to prevent an infant from becoming trapped between an ill fitting infant mattress and the crib. Crib assembly 16 includes crib 11, infant mattress 12 and a bumper assembly 17. Bumper assembly 17 can be made of four connected side pieces that fit around the inside edges of crib 11 above mattress 12. Bumper assembly 17 is intended to cover any gap between mattress 12 and bars 13. In addition, bumper assembly 17 covers bars 13 to a height that a recumbent infant is likely to reach. A twisting and turning infant, however, invariably manages to insert a limb under bumper assembly 17 that can become lodged between a bar of the crib 11 and mattress 12. In FIG. 2, an infant has lodged his left foot in a gap 14 between mattress 12 and a bar 18.

An infant mattress and a crib assembly are sought that prevent infants from becoming trapped between the mattress and a standard crib.

SUMMARY

An infant mattress includes a first foam layer and a ring of visco-elastic foam. The first foam layer of the infant mattress is no greater than fifty-two inches long and twenty-eight inches wide. The ring of visco-elastic foam surrounds the mattress and abuts the four side surfaces of the first foam layer. The ring forms a snug fit with the vertical bars or walls of a crib regardless of whether the dimensions of the particular crib or mattress vary from their standard sizes. Thus, the infant mattress fits safely in the crib without any gap between the mattress and the bars of the crib.

The ring of visco-elastic foam has a width of at least one inch and extends in a vertical dimension at least from the bottom surface to the top surface of the first foam layer. The ring is no more than two inches thick. The memory foam ring intentionally renders the infant mattress somewhat larger than the inner dimensions of the crib. The ring of visco-elastic foam is adapted to compress when the mattress is placed horizontally in a crib having opposing side bars separated by a distance that is smaller than the width of the mattress. The ring is formed by pouring foam into a rectangular mold around the first foam layer. Where the mattress includes pocket coils on the supporting foam layers, the ring of memory foam conforms to the outer row of pocket coils.

In one embodiment, the mattress has a second foam layer whose bottom surface is in contact with the top surface of the first foam layer. The first and second foam layers have equal length dimensions and equal width dimensions. The first foam layer is made of high-density polyurethane foam, and the second foam layer is made of visco-elastic foam.

In another embodiment, the mattress has rows of metal coils in fabric pockets on the top surface of the first foam layer. The fabric pockets of the outer row form an outer surface of half cylinders. Where the ring is formed by pouring foam into a rectangular mold around the first foam layer, the ring of visco-elastic foam conforms to the outer surface of half cylinders.

A crib assembly includes an infant mattress resting on the mattress platform of a crib. Vertical bars are positioned peripherally around the mattress platform. The mattress includes a first foam layer and a ring of visco-elastic foam that abuts the four side surfaces of the first foam layer. The ring of visco-elastic foam has an uncompressed width of at least one inch and extends in a vertical dimension from at least the bottom surface to the top surface of the first foam layer. The width of the mattress is compressed between the vertical bars on one side of the mattress platform and the vertical bars on the opposing side of the mattress platform when the ring of visco-elastic foam is compressed by the vertical bars on opposite sides of the mattress. There is no gap between the mattress and any of the vertical bars positioned peripherally around the mattress platform.

A method includes placing an infant mattress having a ring of memory foam on the support platform of a crib having vertical bars positioned peripherally around the platform. The mattress has a foam layer and a ring of visco-elastic foam that abuts the four side surfaces of the foam layer. The ring has a width of at least one inch and extends in a vertical dimension at least from the bottom surface to the top surface of the foam layer. The width of the ring of visco-elastic foam is compressed by the vertical bars when the mattress is placed on the platform. Moreover, the width of the mattress is compressed between the vertical bars on one side of the platform and the vertical bars on the opposing side of the platform. After the mattress is placed on the platform there is no gap between the mattress and any of the vertical bars positioned peripherally around the platform.

In another embodiment, a crib assembly includes a foam layer of a mattress, a rectangular mattress platform with vertical bars positioned peripherally around the platform, and means for preventing a gap between the mattress and any of the vertical bars. The mattress rests on the mattress platform between the vertical bars. The means abuts the four side surfaces of the foam layer and is compressed by the vertical bars. The inner width of the crib extends from the vertical bars on one longer side of the rectangular platform to the vertical bars on the opposing longer side of the platform. The width of the foam layer is less than the inner width of the crib.

A novel mattress cover adapts a conventional infant mattress to fit snuggly into a crib despite small variations in the dimensions of the infant mattress. The mattress cover includes a ring of visco-elastic foam that surrounds the perimeter of the conventional infant mattress when the mattress cover is placed over the infant mattress. A single piece of visco-elastic foam that forms the ring is glued to the insides of a fabric cover of the mattress cover. Alternatively, the fabric cover includes pockets that contain four foam side pieces that make up the foam ring. The mattress cover is held in place over the infant mattress by an elastic band that pulls the bottom edges of the fabric cover tight and maintains a stretched, flat top surface of the fabric cover over the mattress.

Further details and embodiments are described in the detailed description below. This summary does not purport to define the invention. The invention is defined by the claims.

BRIEF DESCRIPTION OF THE DRAWINGS

The accompanying drawings illustrate embodiments of the invention.

DETAILED DESCRIPTION

Figure 1:
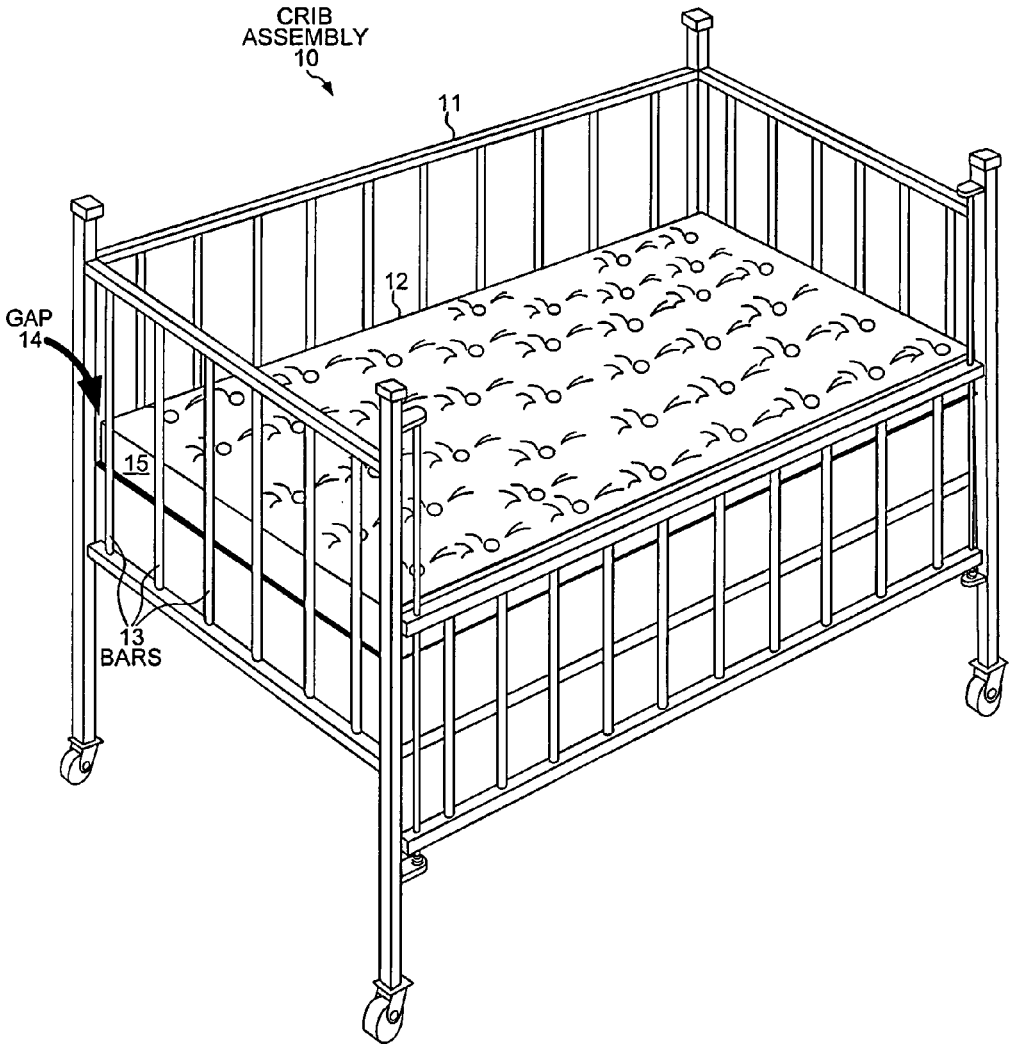
FIG. 1 (PRIOR ART)
FIG. 1 (prior art) is a perspective view of a conventional crib assembly showing a gap between the edges of an infant mattress and the bars of the crib.
Figure 2:
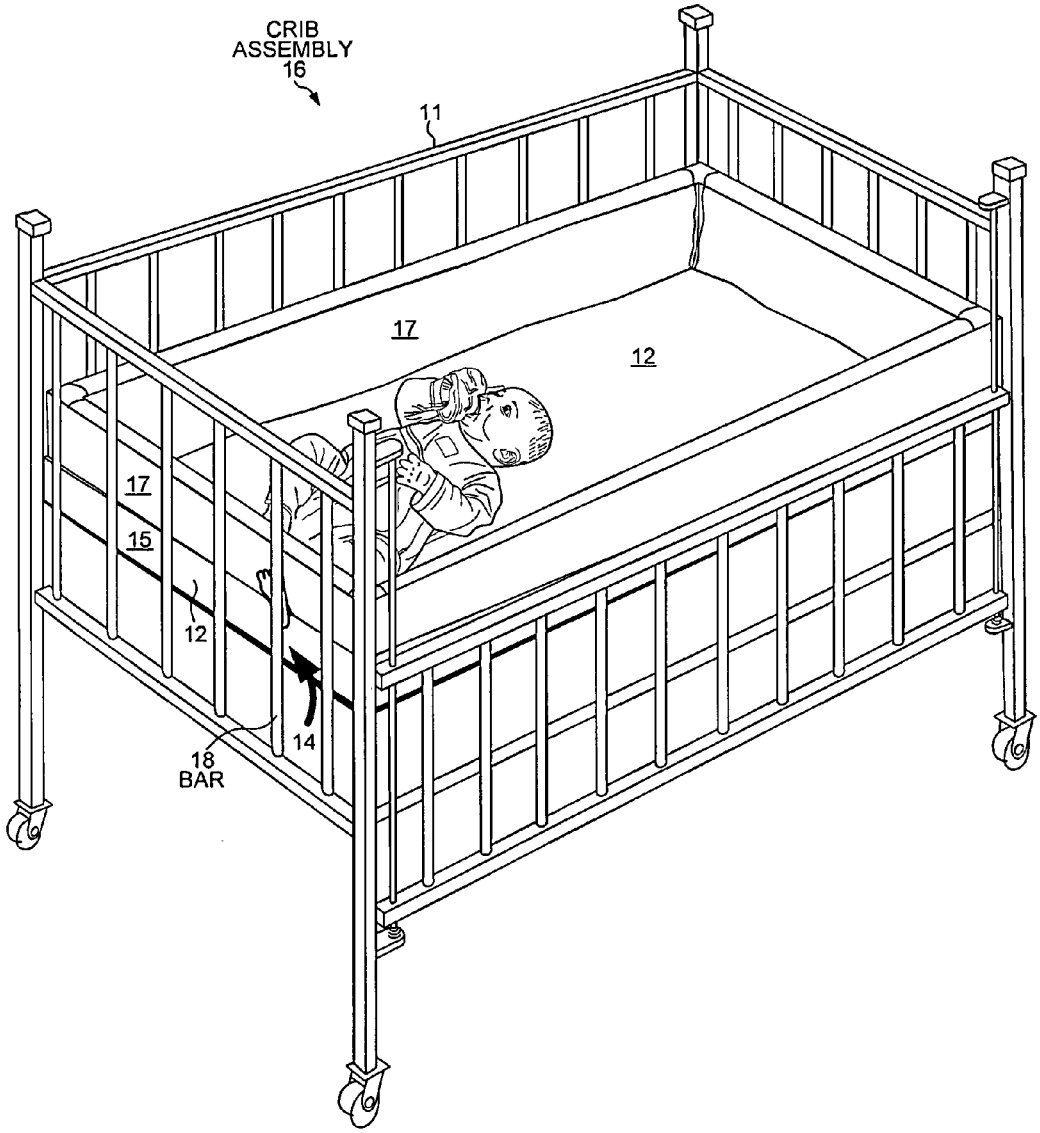
FIG. 2 (PRIOR ART)
FIG. 2 (prior art) is a perspective view of a bumper assembly that fits above a conventional infant mattress and around the inside edges of a crib and that is unsuccessful at preventing an infant from trapping a limb between the mattress and the bars of the crib.
Figure 3:
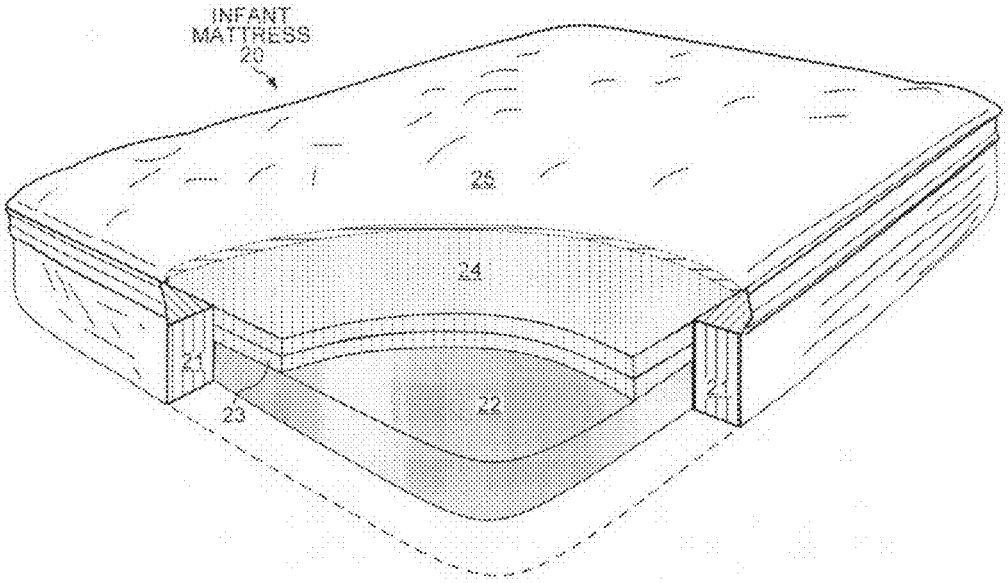
FIG. 3 is a cut-away perspective view of a novel infant mattress that fits snuggly into a crib despite variations in crib and mattress dimensions cause by inconsistent manufacturing processes.

FIG. 3 shows a cross-sectional view of an infant mattress 20 that fits snuggly into a crib despite variations from the stated crib dimensions cause by inconsistent manufacturing processes. In addition, infant mattress 20 fits snuggly into a crib despite small variations in the dimensions of the mattress cause by inconsistent manufacturing processes. Infant mattress 20 has a ring 21 of visco-elastic foam that surrounds the perimeter of the mattress. Visco-elastic foam is sometimes called memory foam. Typically, mattresses do not have a single layer of soft memory foam that extends from the sleeping surface through to the bottom of the mattress. A single layer of memory foam that extends from top to bottom around the perimeter of an adult size mattress would exacerbate the problem of poor edge support caused by people sitting on their mattresses. In a crib mattress, however, ring 21 of memory foam is squeezed into bars 13 of the crib and leaves no gap between infant mattress 20 the bars. Consequently, a crib assembly that includes infant mattress 20 is safer because there is no gap 14 in which an infant's limb could become lodged.

The embodiment of FIG. 3 is a foam mattress that includes a plurality of foam layers whose length and width dimensions are nearly as large as the support surface for the mattress. Ring 21 of visco-elastic foam abuts each of the foam layers on all four sides. FIG. 3 shows an underlying layer 22, a middle layer 23, and a topper layer 24. Underlying layer 22 is made of regular high-density polyurethane foam and provides the stability and underlying support for infant mattress 20. Middle layer 23 is made of memory foam and provides a first cushioning interface of mattress 20. In this embodiment, the memory foam of middle layer 23 has a high density, for example, greater than three pounds per square foot. Memory foam middle layer 23 has an egg crate pattern on its bottom surface. Utilizing an egg crate pattern on at least one surface provides a softer feel normally associated with lower density foam even when higher density foam is used that is inherently more stable.

Topper layer 24 is a fibrous padding layer above the foam middle layer 23. As noted above, foam mattresses are typically produced from polymeric compounds. Sleeping on these polymeric compounds is not unlike sleeping on a plastic tarp. It may not be healthy for an infant to lie on a non-breathable foam surface. For example, it may be that sudden infant death syndrome (SIDS) is caused by the accumulation of carbon dioxide in bedding. If the upper layer of an infant mattress is air impermeable, carbon dioxide is more likely to build up around an infant's face as the infant exhales while lying on her stomach. Fibrous top padding layer 24 is air permeable and is more likely to allow exhaled carbon dioxide to dissipate. Infant mattress 20 has a quilted cover 25 made of terry cloth or some other natural fiber weave. Cover 25 covers all sides of mattress 20, including the outer surfaces of ring 21.

The length and width dimensions of middle layer 23 and topper layer 24 are the same as those of underlying layer 22. In one embodiment, underlying layer 22 is three inches thick, middle layer 23 is two inches thick, and topper layer 24 is one inch thick. The foam of middle layer 23 is glued to the top of underlying layer 22. Likewise, the bottom of topper layer 24 is glued to the top of middle layer 23. The quilting of cover 25 is stitched into topper layer 24. Ring 21 of visco-elastic foam is glued to the sides of layers 22-24. In one embodiment, ring 21 is made of four separate pieces resembling a picture frame. In another embodiment, layers 22-24 are placed in a mold, and memory foam is poured around the layers forming a ring that is a single piece of foam. In one embodiment, the width of ring 21 around layers 22-24 is about one inch. Thus, there is a total of about two inches of squeezable space in each of the length and width dimensions of infant mattress 20. In other embodiments, the width of ring 21 is more than one inch. Inasmuch as memory foam is more costly than HD foam, cost can be reduced by not making ring 21 thicker than required to compensate for the largest probable variations in the manufactured dimensions of mattress 20 and crib 11. It is unlikely that a mattress will be more than one inch too long or too wide, and it is unlikely that the interior dimensions of a crib will be more than one inch too short or too narrow.

The standard inner dimensions of a crib as defined by the Juvenile Products Manufacturers Association are 51⅝ inches by 27¼ inches. Thus, the total dimensions of infant mattress 20 can be slightly larger and will still fit within a standard size crib without bowing or buckling. Ring 21 of visco-elastic foam is compressed at the location of the bars 13 of the crib and absorbs any excess length or width of the mattress. For example, an infant mattress 20 that is twenty-nine inches by fifty-three inches fits within the standard size crib leaving no gap between ring 21 and the crib bars or walls. For the safety of the baby, mothers are advised that no more than two of their fingers should fit between the mattress and the crib. In comparison, there is no room for even one finger between ring 21 and the crib.

Figure 4:
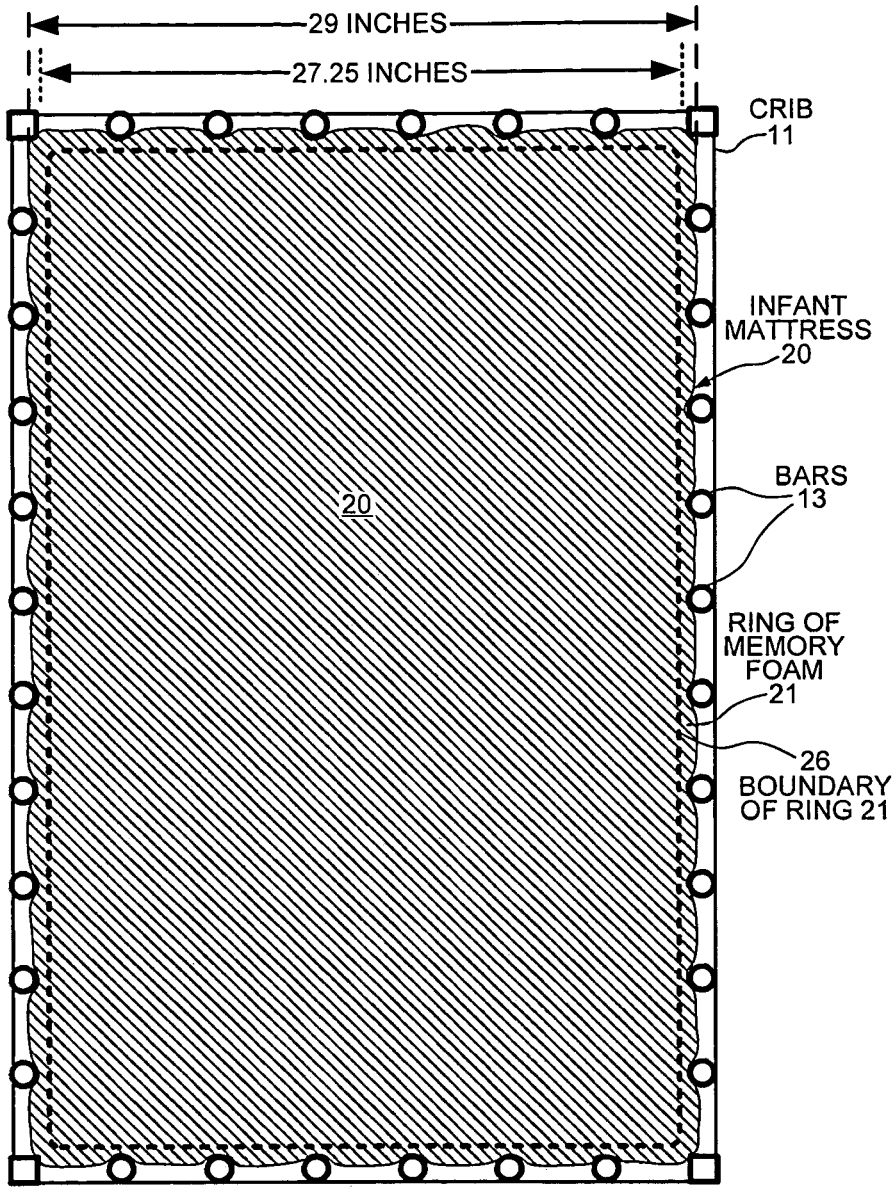
FIG. 4 is a top-down view of the novel infant mattress in a crib showing how a memory foam ring conforms around crib bars to absorb the excess width and length of the mattress compared to the inner dimensions of the crib.

FIG. 4 illustrates how the memory foam of ring 21 conforms around crib bars 13 to absorb the excess width and length of infant mattress 20 compared to the inner dimensions of crib 11. The boundary 26 of memory foam ring 21 around the layers 22-24 is indicated with a dashed line. FIG. 4 shows that there is no gap between infant mattress 20 and the bars of crib 11, even if the particular mattress 20 is manufactured somewhat smaller than the stated dimensions and even if the inner dimensions of crib 11 are manufactured somewhat larger than the stated dimensions.

Figure 5:
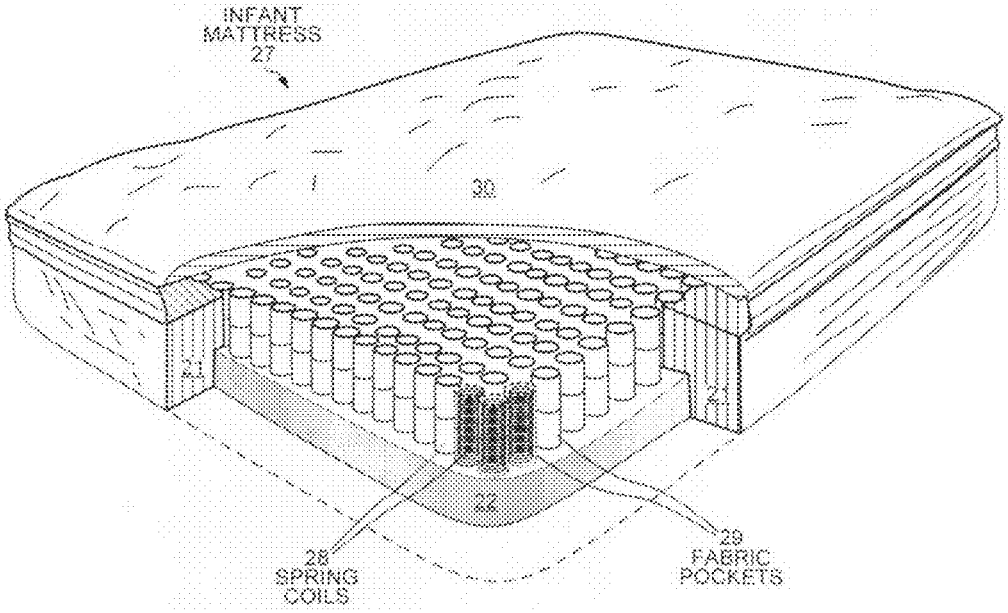
FIG. 5 is a cut-away perspective view of a novel infant mattress with pocket springs that fits safely into a crib despite variations in crib and mattress dimensions.

FIG. 5 shows a cross-sectional view of another embodiment of an infant mattress 27 that fits safely into a crib despite variations from the stated dimensions of the mattress and the crib. Infant mattress 27 is an innerspring mattress with a ring 21 of visco-elastic foam that surrounds underlying layer 22 as well as rows of metal spring coils 28 in fabric pockets 29. The metal coils 28 are supported by underlying layer 22. Each of the metal coils 28 is made of a separate piece of metal instead of one wire being bent to form multiple metal coils. Each of the metal coils 28 is enclosed in a separate fabric pocket 29. Fiber padding may be inserted into each fabric pocket 29 inside of each metal coil 28. The fabric of one row of pockets 29 is glued to the fabric of the next row of pockets 29. In embodiments in which memory foam ring 21 is formed by pouring foam in a mold into which underlying layer 22 and coils 28 have been placed, the foam flows around the outer row of fabric pockets 29 and provides stability to infant mattress 27. As the liquid memory foam cures it naturally affixes itself to both the periphery of the fabric pockets and to the sides of underlying layer 22. Infant mattress 27 has a quilted cover 30 that is thicker than the cover 25 of mattress 20. Cover 30 includes filler material that lies on top of the metal coils 28. The filler material is quilted to the fabric of cover 30 and can be visco-elastic foam, high density (HD) foam or fiber padding.

Figure 6:
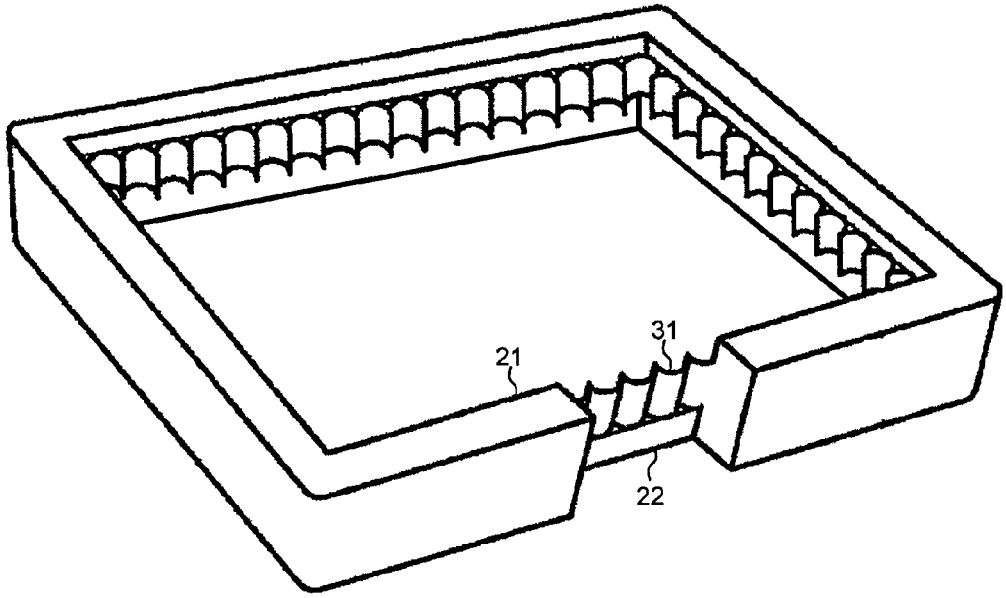
FIG. 6 is a cut-away perspective view of the memory foam ring that conforms to the outer row of pocket coils.

FIG. 6 shows a cut-away view of just ring 21 in the embodiment in which ring 21 is formed in a mold around underlying layer 22 and coils 28 in fabric pockets 29. The outer row of fabric pockets 29 forms an outer surface of half cylinders. FIG. 6 shows that ring 21 of visco-elastic foam conforms to the outer surfaces of layer 22 and of the half cylinders and forms a complementary outline 31.

Figure 7A:
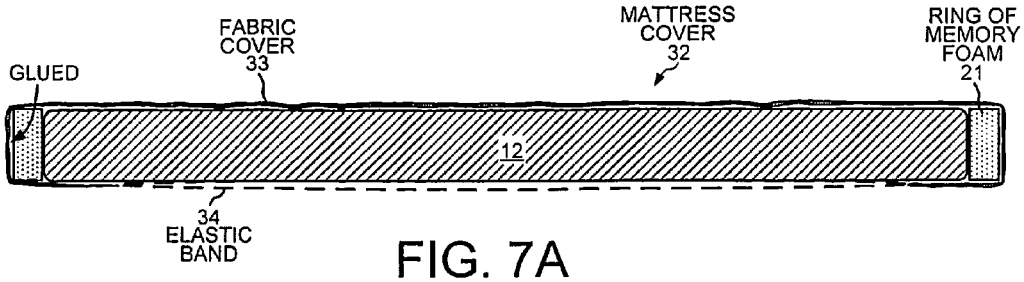
FIGS. 7A-C are views of a novel mattress cover that includes a foam ring inside a fabric cover and that adapts a conventional infant mattress to fit snuggly into a crib.
Figure 7B:
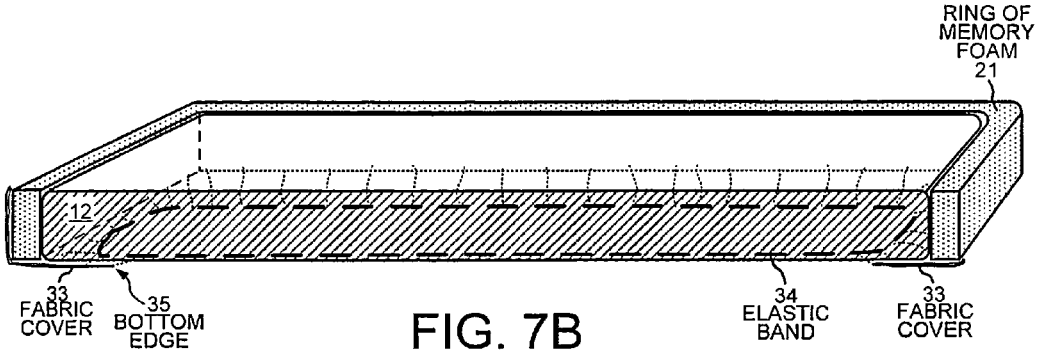
Figure 7C:
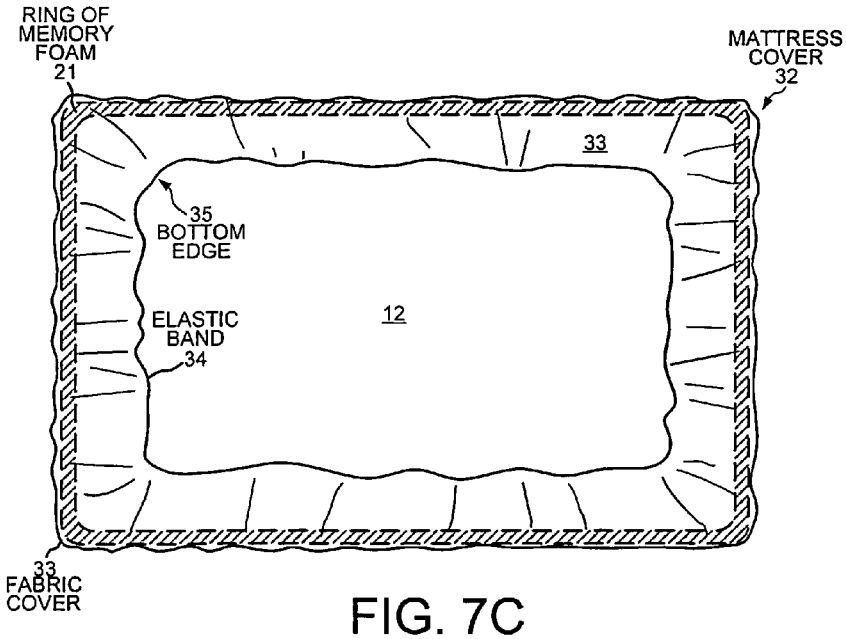

FIGS. 7A-C show a novel mattress cover 32 that adapts a conventional infant mattress 12 to fit snuggly into a crib despite small variations in the dimensions of the mattress 12 cause by inconsistent manufacturing processes. Mattress cover 32 enables a consumer to achieve a safe fit between an existing infant mattress and a crib and obviates the need to buy a new better fitting mattress. Mattress cover 32 includes a ring 21 of visco-elastic foam that surrounds the perimeter of conventional infant mattress 12 when mattress cover 32 is placed over mattress 12. In one embodiment, a fabric cover 33 of mattress cover 32 includes stitched fabric pockets that contain four foam side pieces that make up ring 21. In another embodiment, a single piece of visco-elastic foam forming ring 21 is glued to the insides of fabric cover 33, as shown in FIG. 7A. In the embodiment in which a single piece of foam is glued to the fabric cover, the entire mattress cover 32 can be folded, compressed, rolled and air-sealed for shipment and sale. When the consumer unseals the package, mattress cover 32 expands to its normal size and is ready to place over a conventional infant mattress.

FIG. 7B is a cut-away perspective view showing how mattress cover 32 is held in place over infant mattress 12 by an elastic band 34 that pulls the bottom edge 35 of fabric cover 33 tight. The top fabric surface of fabric cover 33 is not shown in the cut-away view of FIG. 7B. The top fabric surface of fabric cover 33 is stretched flat when the bottom edges are tightened by elastic band 34. FIG. 7C shows mattress cover 32 from the bottom of conventional infant mattress 12. The memory foam of ring 21 of mattress cover 32 conforms around the crib bars to absorb any deficient width or length of infant mattress 12 compared to the inner dimensions of the crib in a manner similar to that described in relation to the embodiment of FIG. 4.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. A mattress comprising:

a first foam layer that is no greater than fifty-two inches long and no greater than twenty-eight inches wide, wherein the first foam layer has a bottom surface and four side surfaces, wherein the mattress has a top surface and a bottom surface, and wherein no layer of foam is disposed above the first foam layer; and a ring of visco-elastic foam that abuts the four side surfaces of the first foam layer, wherein the ring of visco-elastic foam has a width of at least one inch, wherein the ring of visco-elastic foam does not extend above the top surface of the mattress but extends from the to surface of the mattress to the bottom surface of the mattress, and wherein the ring of visco-elastic foam is a single piece of molded foam.

2. The mattress of claim 1, wherein the mattress has a width, and wherein the ring of visco-elastic foam is adapted to compress when the mattress is placed horizontally in a crib having opposing side bars separated by a distance that is smaller than the width of the mattress.

3. The mattress of claim 1, further comprising:

a second foam layer having an upper surface, wherein the upper surface of the second foam layer is in contact with the bottom surface of the first foam layer, and wherein the first foam layer and the second foam layer have equal width dimensions.

4. The mattress of claim 3, wherein the second foam layer is made of high-density polyurethane foam, and wherein the first foam layer is made of visco-elastic foam.

5. The mattress of claim 1, wherein the ring of visco-elastic foam is about one inch thick.

6. The mattress of claim 1, wherein the visco-elastic foam of the ring is softer than the first foam layer.

7. The mattress of claim 1, wherein the first foam layer is covered by a fibrous padding layer.

8. A crib assembly, comprising:

a crib with a horizontal mattress platform and vertical bars positioned peripherally around the mattress platform; and a mattress resting on the mattress platform, wherein the mattress has a top surface and a bottom surface, a first foam layer and a ring of visco-elastic foam, wherein the first foam layer has four side surfaces, wherein no layer of foam is disposed above the first foam layer, wherein the ring of visco-elastic foam abuts the four side surfaces of the first foam layer, wherein the ring of visco-elastic foam has an uncompressed width of at least one inch and extends in a vertical dimension from the top surface of the mattress to at least the bottom surface of the mattress, wherein the ring of visco-elastic foam does not extend above the top surface of the mattress, wherein the width of the ring of visco-elastic foam is compressed by the vertical bars, and wherein the ring of visco-elastic foam is a single piece of molded foam.

9. The crib assembly of claim 8, wherein there is no gap between the mattress and any of the vertical bars positioned peripherally around the mattress platform.

10. A crib assembly, comprising:

a crib with a horizontal mattress platform and vertical bars positioned peripherally around the mattress platform; and a mattress resting on the mattress platform, wherein the mattress includes a first foam layer and a ring of visco-elastic foam, wherein the first foam layer has a bottom surface, a top surface and four side surfaces, wherein the ring of visco-elastic foam abuts the four side surfaces of the first foam layer, wherein the ring of visco-elastic foam has an uncompressed width of at least one inch and extends in a vertical dimension from the top surface of the first foam layer to at least the bottom surface, wherein the ring of visco-elastic foam does not extend above the top surface of the first foam layer, wherein the width of the ring of visco-elastic foam is compressed by the vertical bars, wherein the mattress has a width, and wherein the width of the mattress is compressed between the vertical bars on one side of the mattress platform and the vertical bars on an opposing side of the mattress platform.

11. A method comprising:

placing a mattress on a platform of a crib having vertical bars positioned peripherally around the platform, wherein the mattress has a top surface and a bottom surface, a first foam layer and a ring of visco-elastic foam, wherein the first foam layer has four side surfaces, wherein no layer of foam is disposed above the first foam layer, wherein the ring of visco-elastic foam abuts the four side surfaces of the first foam layer, wherein the ring of visco-elastic foam has a width of at least one inch and extends in a vertical dimension from the top surface of the mattress to at least the bottom surface of the mattress, wherein the ring of visco-elastic foam is a single piece of molded foam and does not extend above the top surface of the mattress, and wherein the width of the ring of visco-elastic foam is compressed by the vertical bars when the mattress is placed on the platform.

12. The method of claim 11, wherein after the mattress is placed on the platform there is no gap between the mattress and any of the vertical bars positioned peripherally around the platform.

13. A method comprising:

placing a mattress on a platform of a crib having vertical bars positioned peripherally around the platform, wherein the mattress has a first foam layer and a ring of visco-elastic foam, wherein the first foam layer has a bottom surface, a top surface and four side surfaces, wherein the ring of visco-elastic foam abuts the four side surfaces of the first foam layer, wherein the ring of visco-elastic foam has a width of at least one inch and extends in a vertical dimension from the top surface of the first foam layer to at least the bottom surface of the first foam layer, wherein the ring of visco-elastic foam does not extend above the top surface of the first foam layer, and wherein the width of the ring of visco-elastic foam is compressed by the vertical bars when the mattress is placed on the platform, wherein the mattress has a width, and wherein the width of the mattress is compressed between the vertical bars on one side of the platform and the vertical bars on an opposing side of the platform.

14. A crib assembly, comprising:

a crib with a rectangular mattress platform and vertical bars positioned peripherally around the mattress platform, wherein an inner width of the crib extends from the vertical bars on one longer side of the platform to the vertical bars on an opposing longer side of the platform;

a first foam layer of a mattress, wherein the mattress has a top surface and a bottom surface, wherein the mattress rests on the mattress platform, wherein the first foam layer has a length, a width, a top surface and four side surfaces, wherein no layer of foam is disposed above the first foam layer, and wherein the width of the first foam layer is less than the inner width of the crib; and means for preventing a gap between the mattress and any of the vertical bars, wherein the means abuts the four side surfaces of the first foam layer and extends from the top surface of the mattress to at least the bottom surface of the mattress, and wherein the means is a single piece of molded foam.

15. The crib assembly of claim 14, wherein the first foam layer has a bottom surface and a top surface, and wherein the means extends in a vertical dimension from at least the bottom surface to the top surface of the first foam layer.

16. The crib assembly of claim 14, wherein the means is compressed by the vertical bars.

17. The crib assembly of claim 14, wherein the first foam layer is made of polyurethane foam, and wherein the means is made of visco-elastic foam.

18. The crib assembly of claim 14, wherein the means has a width of at least one inch.

* * * * *